US007506514B2

(12) United States Patent
Muldoon et al.

(10) Patent No.: US 7,506,514 B2
(45) Date of Patent: Mar. 24, 2009

(54) AUGMENTOR FUEL CONDUIT BUSHING

(75) Inventors: Marc J. Muldoon, Marlborough, CT (US); Meggan H. Harris, Colchester, CT (US); Robert T. Brooks, Killingworth, TX (US); Tor W. Sherwood, San Diego, CA (US)

(73) Assignee: United Technologies Corporation, Hartford, CT (US)

( * ) Notice: Subject to any disclaimer, the term of this patent is extended or adjusted under 35 U.S.C. 154(b) by 591 days.

(21) Appl. No.: 11/174,087

(22) Filed: Jun. 30, 2005

(65) Prior Publication Data

US 2007/0006589 A1 Jan. 11, 2007

(51) Int. Cl.
*F02K 3/10* (2006.01)

(52) U.S. Cl. ..... 60/761; 60/796

(58) Field of Classification Search ..... 60/761, 60/763, 765, 766, 796, 800
See application file for complete search history.

(56) References Cited

U.S. PATENT DOCUMENTS

| | | | | |
|---|---|---|---|---|
| 3,793,838 | A * | 2/1974 | Nash | 60/764 |
| 5,385,015 | A | 1/1995 | Clements et al. | |
| 5,685,140 | A | 11/1997 | Clements et al. | |
| 2005/0084190 | A1 * | 4/2005 | Brooks et al. | 384/276 |
| 2006/0016194 | A1 * | 1/2006 | Roche et al. | 60/765 |
| 2007/0028621 | A1 * | 2/2007 | Muldoon et al. | 60/761 |

* cited by examiner

*Primary Examiner*—Louis J Casaregola
(74) *Attorney, Agent, or Firm*—Bachman & LaPointe, P.C.

(57) ABSTRACT

A gas turbine engine augmentor has a centerbody within a gas flowpath from upstream to downstream. A plurality of vanes are positioned in the gas flowpath outboard of the centerbody. An augmenter fuel conduit extends through a first of the vanes to deliver fuel to the centerbody. An electrographitic carbon bushing guides and supports the augmentor fuel conduit.

8 Claims, 3 Drawing Sheets

AUGMENTOR FUEL CONDUIT BUSHING

U.S. GOVERNMENT RIGHTS

The invention was made with U.S. Government support under contract N00019-02-C-3003 awarded by the U.S. Navy. The U.S. Government has certain rights in the invention.

BACKGROUND OF THE INVENTION

This invention relates to turbine engines, and more particularly to turbine engine augmentors.

Afterburners or thrust augmentors are known in the industry. A number of configurations exist. In a typical configuration, exhaust gases from the turbine pass over an augmentor centerbody. Additional fuel is introduced proximate the centerbody and is combusted to provide additional thrust. In some configurations, the augmentor centerbody is integrated with the turbine centerbody. In other configurations, the augmentor centerbody is separated from the turbine centerbody with a duct surrounding an annular space between the two. U.S. Pat. Nos. 5,685,140 and 5,385,015 show exemplary integrated augmentors.

The centerbody may contain a burner serving as a combustion source. For introducing the additional fuel, a number of spray bars may be positioned within generally radially extending vanes. A pilot may be proximate an upstream end of the tailcone. Alternatively or additionally to the burner, a number of igniters may be positioned within associated ones of the vanes to ignite the additional fuel. Trailing portions of the vanes may serve as flameholder elements for distributing the flame across the flow path around the centerbody.

Separately, electro-graphitic carbon materials have been developed for a variety of uses. US Pre-grant Publication 20050084190A1 discloses a variable vane inner diameter (ID) bushing made from electro-graphitic carbon.

SUMMARY OF THE INVENTION

Accordingly, one aspect of the invention involves a turbine engine augmentor. A centerbody is positioned within a gas flowpath from upstream to downstream. A plurality of vanes are positioned in the gas flowpath outboard of the centerbody. An augmentor fuel conduit extends through a first of the vanes to deliver fuel to the centerbody. An electrographitic carbon bushing guides and supports the augmentor fuel conduit.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
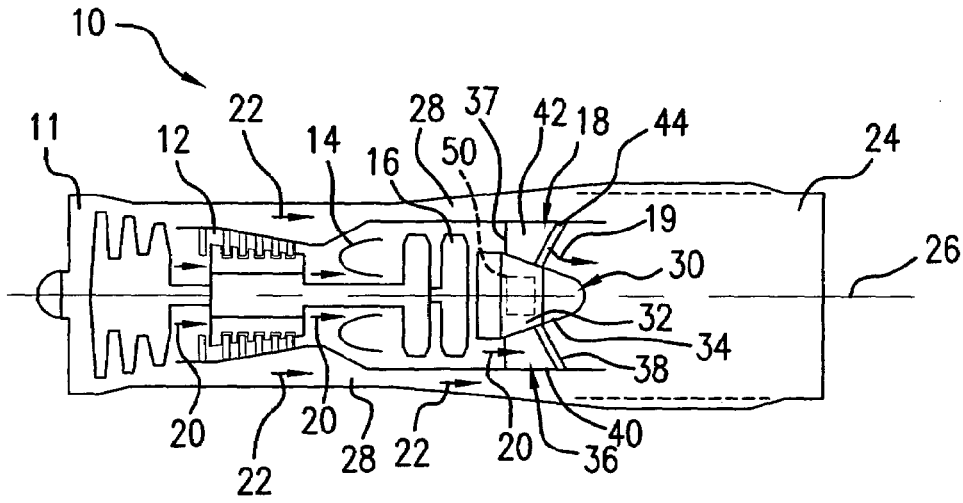
FIG. 1 is a schematic longitudinal sectional view of an aircraft powerplant.

FIG. 1 shows a gas turbine engine 10 comprising, from upstream to downstream and fore to aft, a fan 11, a compressor 12, a combustor 14, a turbine 16, and an augmentor 18. Air entering the fan 11 is divided between core gas flow 20 and bypass air flow 22. Core gas flow 20 follows a path initially passing through the compressor 12 and subsequently through the combustor 14 and turbine 16. Finally, the core gas flow 20 passes through the augmentor 18 where additional fuel 19 is selectively added, mixed with the flow 20, and burned to impart more energy to the flow 20 and consequently more thrust exiting an engine nozzle 24. Hence, core gas flow 20 may be described as following a path essentially parallel to the axis 26 of the engine 10, through the compressor 12, combustor 14, turbine 16, and augmentor 18. Bypass air 22 also follows a path parallel to the axis 26 of the engine 10, passing through an annulus 28 along the periphery of the engine 10 to merge with the flow 20 at or near the nozzle 24.

Figure 2:
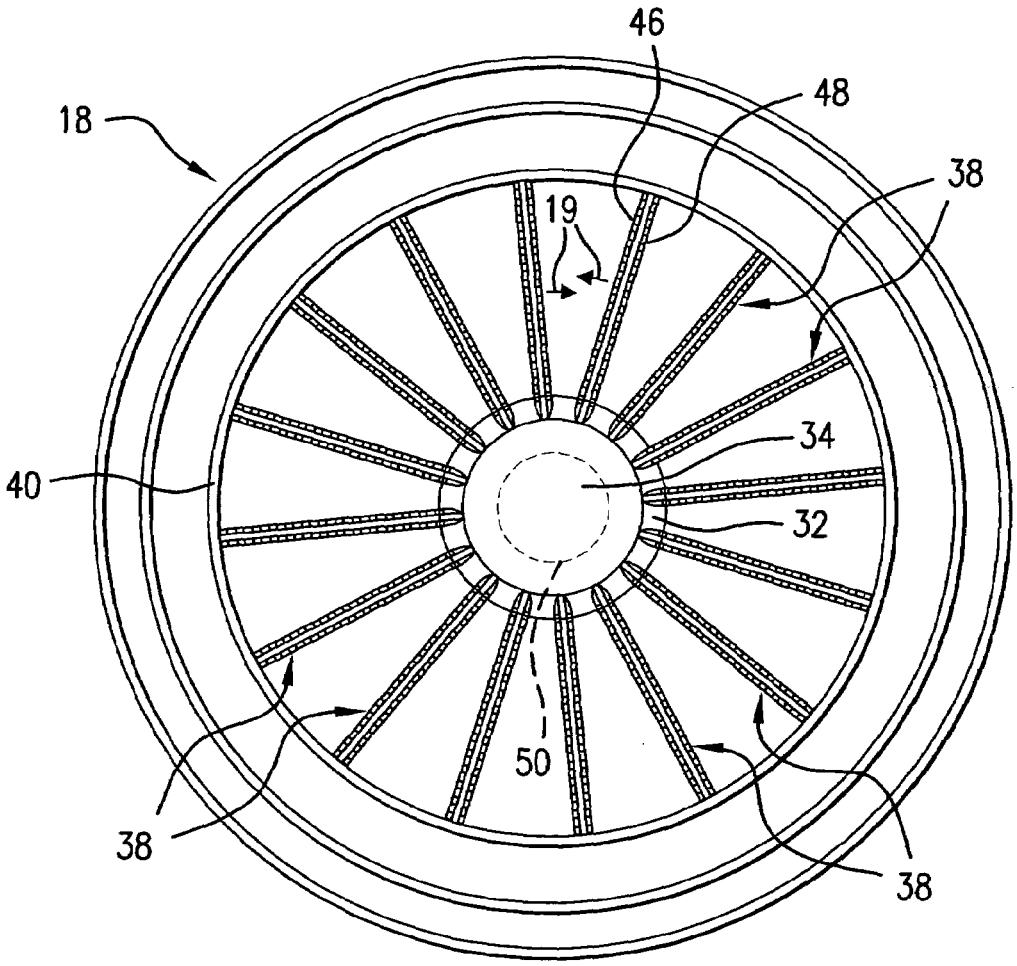
FIG. 2 is an aft view of an augmentor of the powerplant of FIG. 1.

The augmentor comprises a centerbody 30 generally symmetric around the axis 26 and formed as a portion of an engine hub. The exemplary centerbody has a main portion 32 and a tailcone 34 downstream thereof. Circumferentially arrayed vanes 36 have leading and trailing extremities 37 and 38 and extend generally radially between the centerbody 30 and a turbine exhaust case (TEC) 40. Each of the vanes may be an assembly of a leading main body portion 42 and a trailing edge box 44. The vanes have circumferentially opposite first and second sides 46 and 48 (FIG. 2). The trailing edge box 44 may contain a spray bar (discussed below) for introducing the additional fuel 19. The centerbody may contain a burner 50 for combusting fuel to, in turn, initiate combustion of the fuel 19. The burner 50 and spray bars may be supplied from one or more supply conduits (not shown) extending through or along one or more of the vanes to the centerbody. As so far described, the engine configuration may be one of a number of existing engine configurations to which the present teachings may apply. However, the teachings may also apply to different engine configurations.

Figure 3:
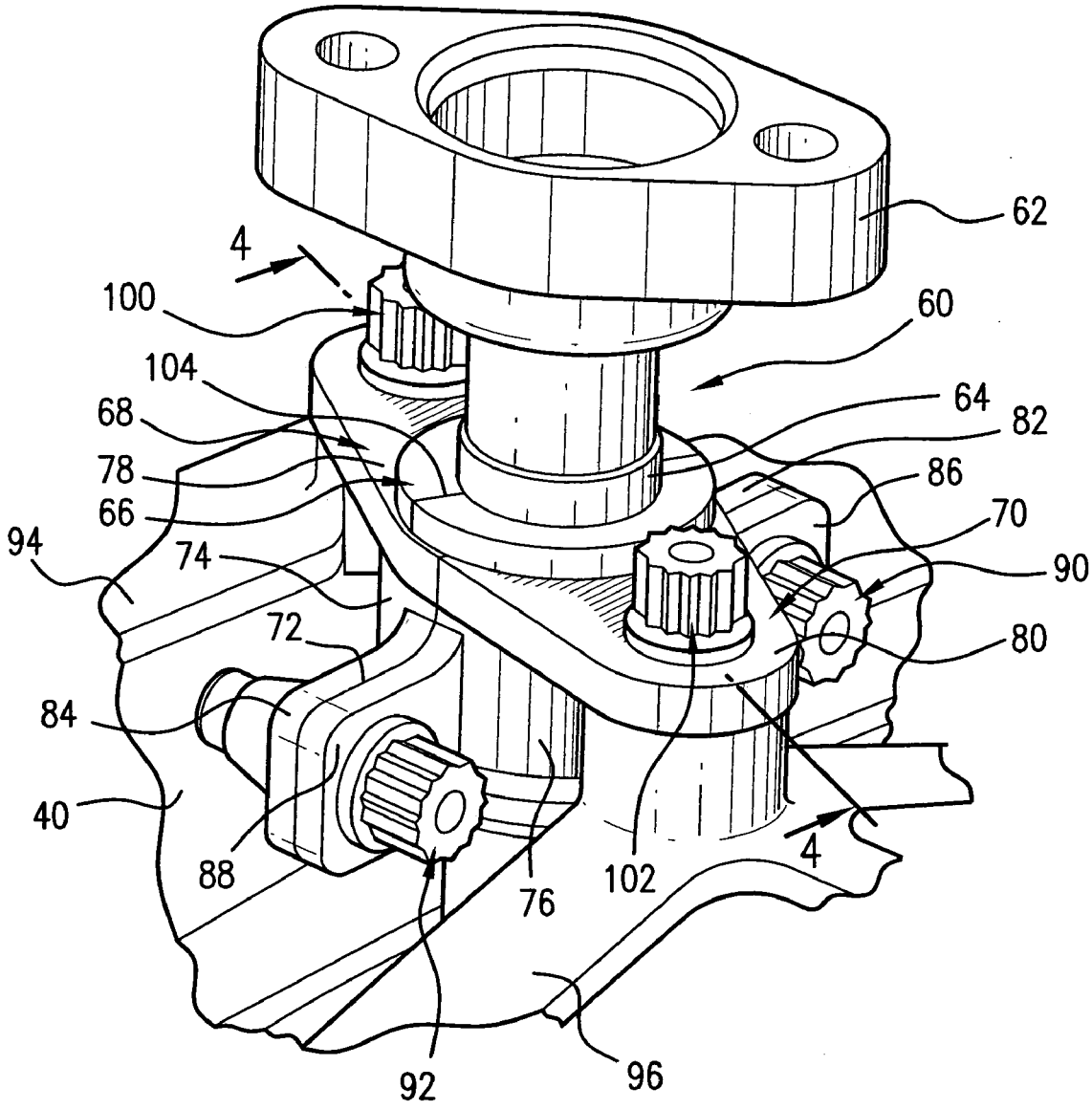
FIG. 3 is a view of an outboard end of an augmentor fuel supply conduit.

FIG. 3 shows an outboard end portion of the supply conduit 60 mounted to the TEC 40. The conduit has an outboard end flange 62 for mating to the downstream end of an upstream supply conduit (not shown). A cylindrical body portion 64 of the conduit 60 is supported by a bushing 66. The bushing 66 is, in turn, supported between a pair of brackets 68 and 70 mated along a mating/parting plane 72. The brackets each have a collar/boss portion 74; 76 and a mounting ear 78; 80 extending from an outboard end of the collar/boss portion.

The brackets 68 and 70 have pairs of mounting ears 82; 84 and 86; 88 extending from edges of the associated collar/boss portion 74; 76 and meeting along the plane 72. Each ear is secured to an opposite ear of the other bracket by a fastener (e.g., bolts/nuts 90 and 92). The brackets 68 and 70 are, in turn, secured to support brackets 94 and 96, respectively, by bolts 100 and 102. The brackets 94 and 96 are, in turn, mounted to the turbine exhaust case 40.

Figure 4:
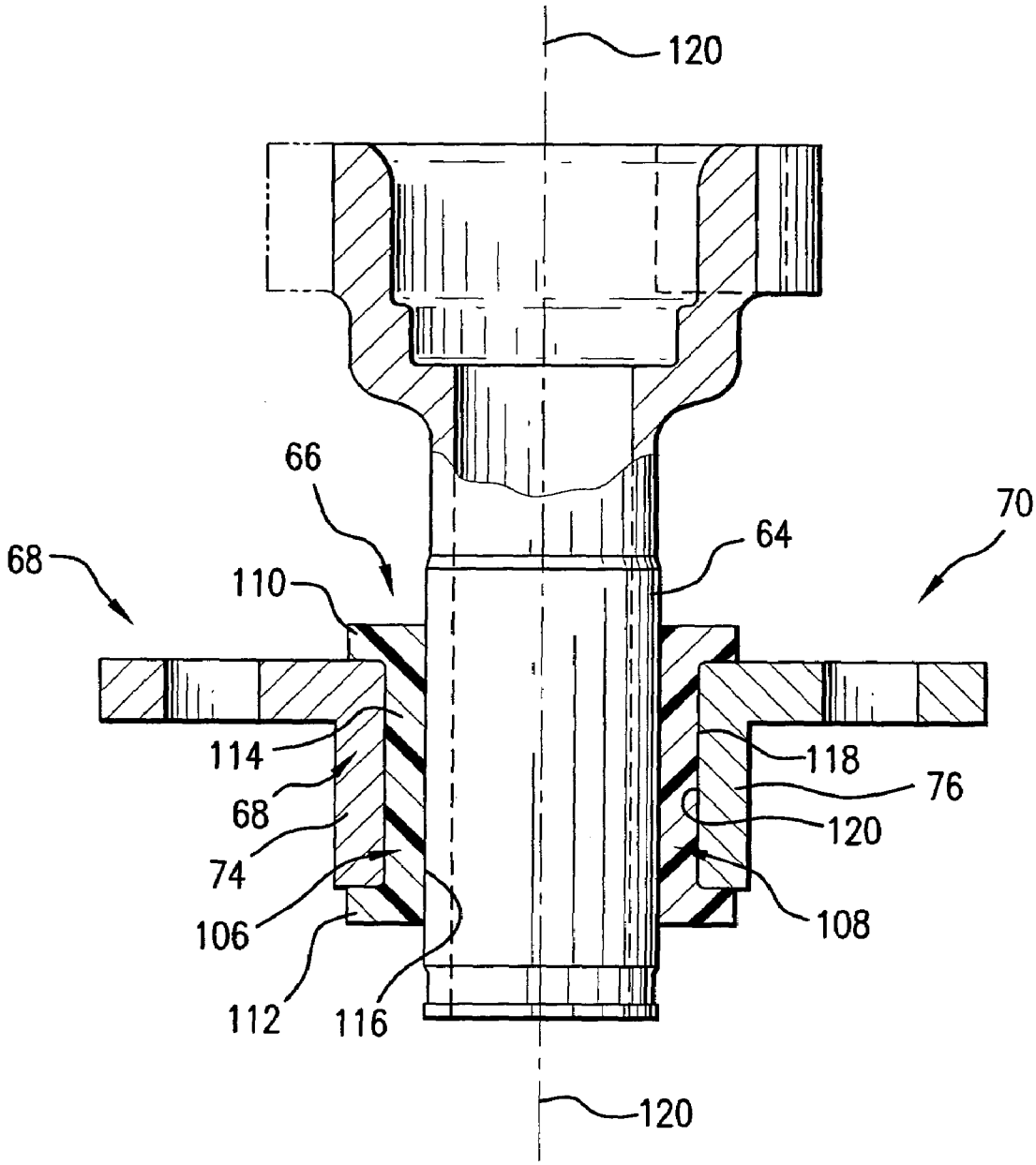
FIG. 4 is a sectional view of the conduit of FIG. 3, taken along line 4-4.

The exemplary bushing 66 is longitudinally split along a parting plane 104 into first and second pieces 106 and 108 (FIG. 4). FIG. 4 further shows the bushing as having outboard and inboard end flanges 110 and 112 connected by a circular cylindrical tubular body 114. In the exemplary implementation, the bushing parting plane 104 is non-coincident with the bracket parting plane 72 (e.g., off-parallel thereto). The bushing has a circular cylindrical inner surface 116 in sliding engagement with the conduit portion 64. The lateral exterior surface 118 of the bushing body 114 may be in contact with an inboard surface 120 of the boss portions 74 and 76 of the combined brackets 68 and 70. Engagement of the boss portions 74 and 76 with the adjacent surfaces of the flanges 110 and 112 longitudinally retains the bushing to the brackets 68 and 70.

FIG. 4 further shows a central longitudinal axis 120 shared by the conduit body portion 64 and the bushing 66. In the exemplary embodiment, the sliding engagement between the bushing and the conduit permits relative translation along the axis 120 and relative rotation about the axis 120. In particular, vibration, and differential thermal expansion, may produce such translation and rotation of the conduit relative to the TEC 40 (and thereby relative to the brackets 68 and 70 and bushing 66). The axis 120 may be coincident with a local radial direction of the engine or may be slightly off-radial (e.g., to permit the conduit 60 to be appropriately oriented within the associated vane).

The exemplary bushing consists essentially of electro-graphitic carbon. This material is believed to have an advantageous combination of preferential wear relative to the conduit material (e.g., a nickel-based superalloy) with which the bushing interacts. In addition to wearing preferentially to mating details, the electrographitic material used for the wear members may deposit a thin layer of graphite at the wear interface. This deposition may serve to further reduce the rates of wear. Additionally, the electro-graphitic carbon has advantageous temperature stability relative to polymers and other non-metallic sacrificial wear materials used in other applications.

Alternative implementations may be other than monolithic electro-graphitic carbon structures. For example, the bushings may have structural cores of another material (e.g., a metal) or could have additional layers such as coatings.

One or more embodiments of the present invention have been described. Nevertheless, it will be understood that various modifications may be made without departing from the spirit and scope of the invention. Accordingly, other embodiments are within the scope of the following claims.

What is claimed is:

1. A turbine engine augmentor comprising:

a centerbody within a gas flowpath from upstream to downstream;

a plurality of vanes positioned in the gas flowpath outboard of the centerbody;

an augmenter fuel conduit extending through a first of the vanes to deliver fuel to the centerbody; and an electrographitic carbon bushing, the augmentor fuel conduit mounted to an engine static structure via the electrographitic carbon bushing, the electrographitic carbon bushing being in longitudinally sliding engagement with the augmentor fuel conduit so that the electrographitic carbon bushing guides the augmentor fuel conduit relative to the static structure.

2. The turbine engine augmentor of claim 1 wherein the augmentor fuel conduit delivers the fuel to a burner within the centerbody.

3. The turbine engine augmentor of claim 1 wherein the augmentor fuel conduit delivers the fuel to a spray bar manifold within the centerbody.

4. The turbine engine augmentor of claim 1 wherein the bushing is a split bushing.

5. The turbine engine augmentor of claim 1 wherein the bushing is a longitudinally split bushing.

6. The turbine engine augmentor of claim 1 wherein the bushing has first and second end flanges.

7. The turbine engine augmentor of claim 1 wherein:

the engine static structure is a turbine exhaust case (TEC); and the bushing is supported between a pair of brackets to the turbine exhaust case.

8. The turbine engine augmentor of claim 1 wherein:

the electrographitic carbon bushing is in rotational sliding engagement with the augmentor fuel conduit.

* * * * *